US007264045B2

(12) United States Patent
Mehendale et al.

(10) Patent No.: US 7,264,045 B2
(45) Date of Patent: Sep. 4, 2007

(54) PLATE-TYPE EVAPORATOR TO SUPPRESS NOISE AND MAINTAIN THERMAL PERFORMANCE

(75) Inventors: Sunil S. Mehendale, Williamsville, NY (US); Gary Scott Vreeland, Medina, NY (US); Scott B. Lipa, Snyder, NY (US)

(73) Assignee: Delphi Technologies, Inc., Troy, MI (US)

( * ) Notice: Subject to any disclaimer, the term of this patent is extended or adjusted under 35 U.S.C. 154(b) by 95 days.

(21) Appl. No.: 11/209,500

(22) Filed: Aug. 23, 2005

(65) Prior Publication Data

US 2007/0044946 A1 Mar. 1, 2007

(51) Int. Cl.
*F28D 1/03* (2006.01)

(52) U.S. Cl. ..... 165/166; 165/153; 165/170

(58) Field of Classification Search ..... 165/166, 165/167, 170, 153
See application file for complete search history.

(56) References Cited

U.S. PATENT DOCUMENTS 4,081,025 A * 3/1978 Donaldson ..... 165/140
4,209,064 A * 6/1980 Cacalloro et al. ..... 165/130
4,723,601 A * 2/1988 Ohara et al. ..... 165/153
5,111,878 A * 5/1992 Kadle ..... 165/176
5,409,056 A * 4/1995 Farry et al. ..... 165/153
5,538,077 A * 7/1996 So et al. ..... 165/109.1
5,964,282 A * 10/1999 Seiler et al. ..... 165/153
5,996,633 A * 12/1999 Kato ..... 165/166
6,244,334 B1 * 6/2001 Wu et al. ..... 165/166
6,289,982 B1 * 9/2001 Naji ..... 165/177
6,453,989 B1 * 9/2002 Watanabe et al. ..... 165/177
2004/0069441 A1 * 4/2004 Burgers et al. ..... 165/41
2004/0107718 A1 * 6/2004 Bowman et al. ..... 165/122

* cited by examiner

*Primary Examiner*—Teresa J. Walberg
(74) *Attorney, Agent, or Firm*—Patrick M. Griffin

(57) ABSTRACT

A heat exchanger assembly including a plurality of pairs of plates disposed in series for fluid flow from a pass through one pair of plates to a pass through the next pair of plates. Each pair of plates includes a central rib to define a U-shaped passage having a fluid entering leg and a fluid exiting leg interconnected by an open bottom interconnecting the legs below the lower end of the engaging central ribs. A plurality of dimples project into the passage to interact with fluid flow through the passage and each of the dimples has a hemispherical shape and a divider rib is disposed in the passage to co-act with the hemispherical dimples to reduce whistling noise.

9 Claims, 6 Drawing Sheets

PLATE-TYPE EVAPORATOR TO SUPPRESS NOISE AND MAINTAIN THERMAL PERFORMANCE

BACKGROUND OF THE INVENTION

1. Field of the Invention

The present invention relates to a heat exchanger assembly, and more particularly, to an evaporator for a heating and/or air conditioning system (HVAC) for automotive vehicles.

2. Description of the Prior Art

An evaporator of the type to which the subject invention pertains exchanges heat between a cooling fluid and air. A stack of virtually identical plates are positioned symmetrically in pairs having mating edges and a concave region delimited by the edges to define a fluid passage. The plates have tubular projections defining an inlet for entering fluid to the passage and an outlet for exiting fluid from the passage to thereby establish a direction of fluid flow. Each inlet is connected to the outlet of the preceding pair of plates and each outlet is connected to the inlet of the next pair of plates. Actually, each pair of plates includes a central rib to define a U-shaped passage having a fluid entering leg and a fluid exiting leg interconnected by an open bottom. Examples of such heat exchangers are described in U.S. Pat. No. 5,111,878 to Kadle and U.S. Pat. No. 5,409,056 to Farry, Jr. et al.

Hot and humid air flows between the consecutive pairs of plates. The plates are usually stamped of thin gauge metal and a plurality of dimples is stamped into the plates to project into the passage to interact with fluid flow through the passage. These dimples can be identical in shape, position and orientation or they can be of various shapes as illustrated in U.S. Pat. No. 6,289,982 to Naji. They project into the interior of the passage formed by the pairs of plates and thus allow better heat exchange by agitating the cooling fluid flow, and especially by promoting its movement in a turbulent flow. These dimples can be formed by an assembly method, particularly by brazing two bosses opposite each other. In this case, the plates forming a pair of plates are the same as one another, and each boss has an equivalent height of approximately one-half of the depth of the U-shaped passage, that is to say of the distance from the opposing plates.

Unfortunately the flow of cooling fluid in this type of evaporator can produce a noise, particularly a "whistling", i.e., a tonal noise emanating from a plate-type evaporator used in certain automotive climate control systems under transient conditions. It is believed that this tonal noise occurs when gaseous refrigerant at sufficiently high velocities flows over the first dimples. It is further believed that the tonal noise is caused by periodic flow instability (manifested as vortices) in the wake of the first dimples. When the vortex shedding frequency is near the natural frequency of the gas column perpendicular to the direction of flow, a strong acoustic oscillation of the vapor column is excited, and it is this resonant oscillation that is believed to be the source of the tonal noise or whistle.

It is believed that a flow-induced whistle occurs when superheated refrigerant flows through the dimpled tube plate passages. When refrigerant vapor at sufficiently high velocity flows over the dimples in the evaporator tube plates, the flow sets up a periodic flow instability, also known as vortices, in the wake of the dimples. Initially, as the flow velocity increases, the frequency of the vortex shedding also increases. This phenomenon is known as "Strouhal effect".

SUMMARY OF THE INVENTION AND ADVANTAGES

The invention resides in a flow divider rib disposed in the fluid passage and parallel to the direction of fluid flow to thereby divide the fluid passage.

The divider rib combined with smaller hemispherical dimples has proven effective in reducing tonal noise under certain conditions.

As the flow velocity increases, and when the vortex shedding frequency happens to be near the natural frequency of the gas column perpendicular to the flow direction, a strong acoustic oscillation of the gas column is excited, and it is this resonant oscillation that is perceived as a tonal noise or whistle. When acoustic resonance is excited, all the vortices are "locked" in at a certain frequency, so to say. Once this vortex locking has occurred, any increase in velocity does not affect the frequency of the pure tone, but does increase the amplitude of the excitation.

The resonant frequency is inversely proportional to the channel width in some evaporators. The shape, size, and distribution of the bumps will affect the character of the whistle by influencing the energy associated with vortex shedding. Hence, in order to suppress or mitigate the flow-induced whistle, the subject invention provides smaller dimples that are hemispherical and packed at an optimum density in a flow channel of limited width. An evaporator with these features eliminates the flow-induced whistle and also provides comparable thermal performance. Typically, the two changes of converting oblong bumps into smaller round bumps and providing a central rail to limit channel width by themselves would have resulted in a thermal performance loss. The reason for this is that although smaller round bumps may shed vortices of lesser intensity (and therefore mitigates or eliminates the whistle), they do not spread the liquid refrigerant as much as the oblong bumps do. This would cause a lower heat transfer effectiveness and lower performance. The middle rail to limit the channel width inhibits the transverse mixing of the refrigerant, which would adversely affect thermal performance. To overcome these potential losses, the round bumps are more densely packed than the oblong bumps.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
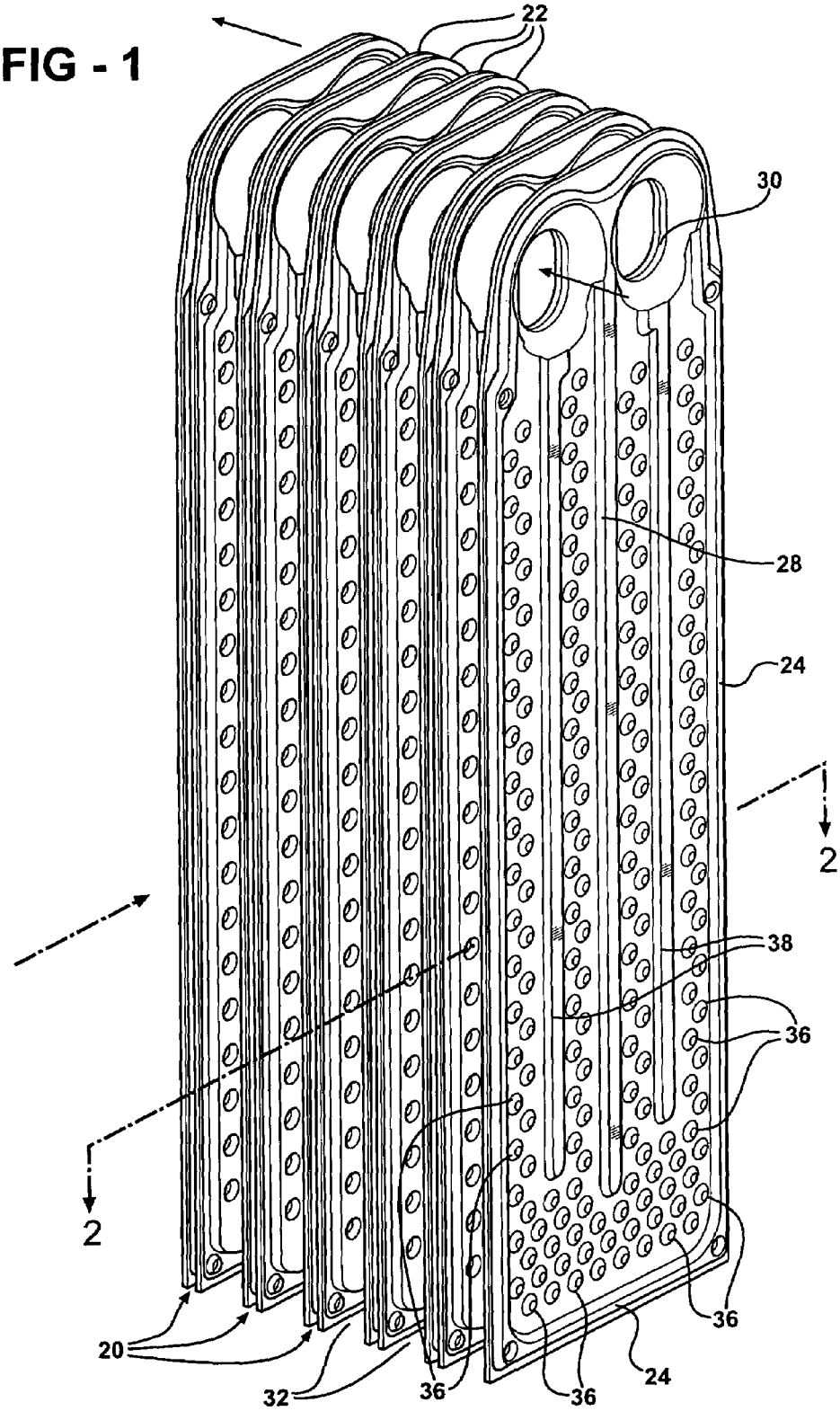
FIG. 1 is a perspective view of a plurality of pairs of plates in a U-channel evaporator incorporating the subject invention.
Figure 2:
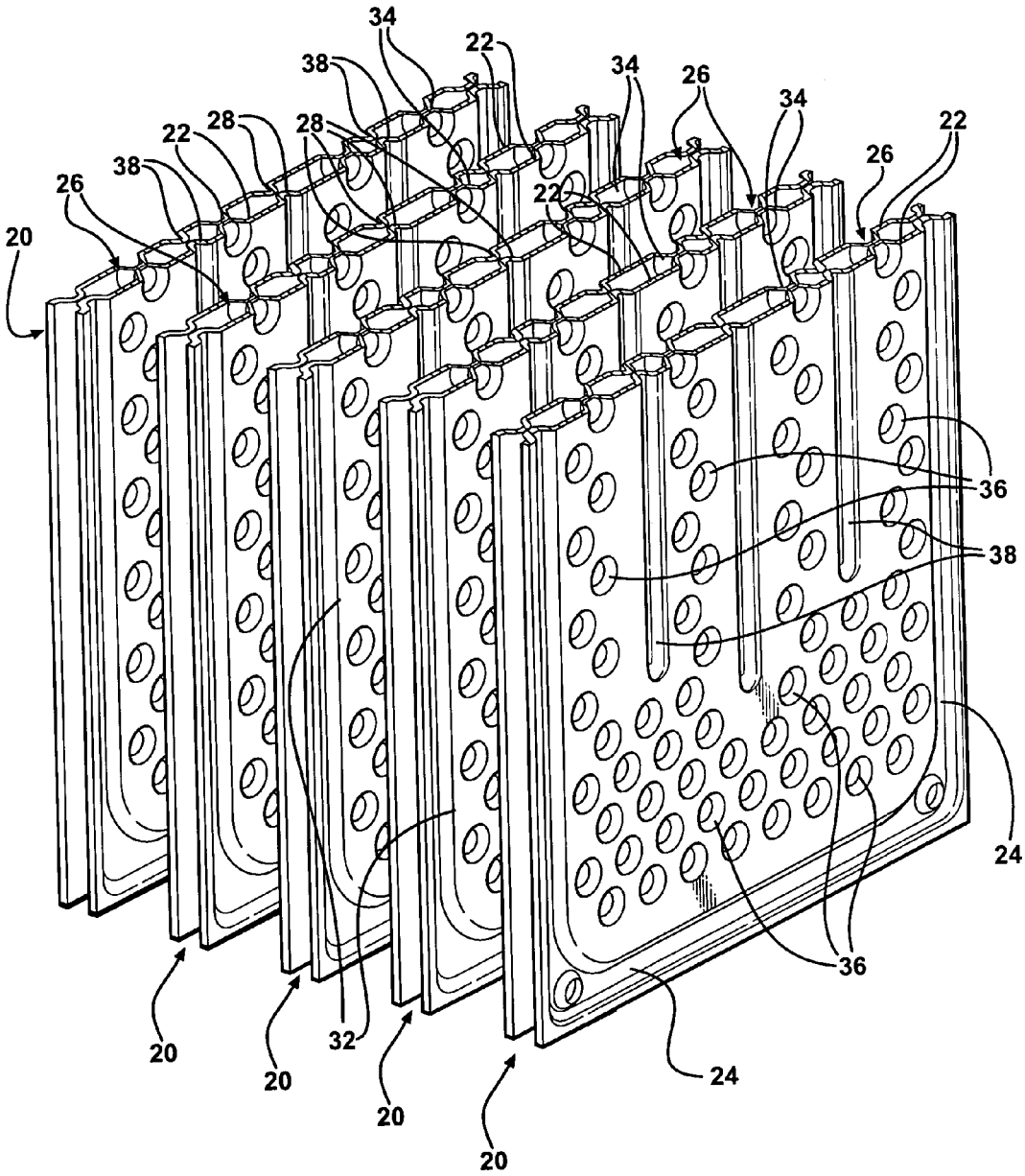
FIG. 2 is a cross sectional perspective view taken along line 2-2 of FIG. 1.
Figure 3:
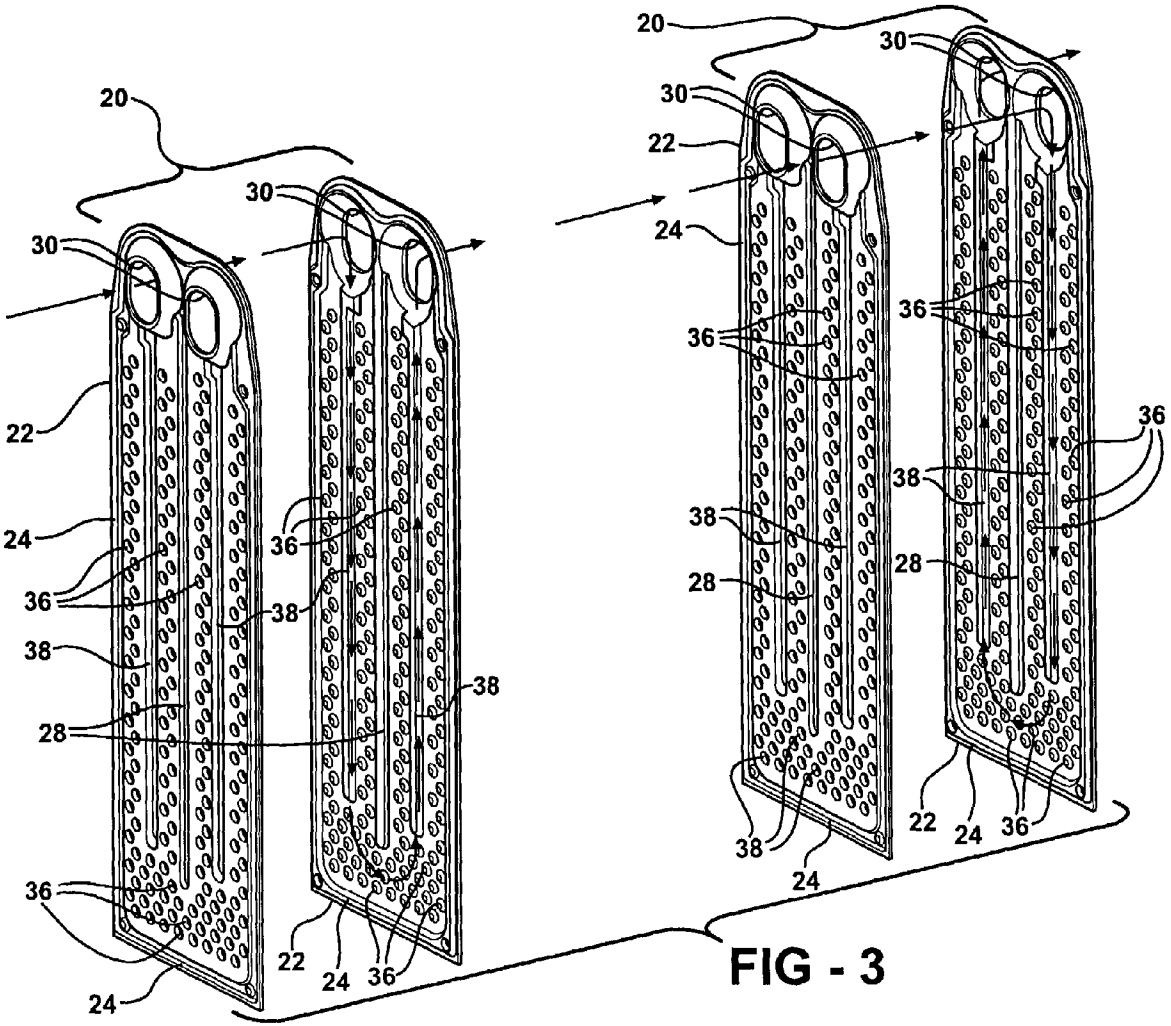
FIG. 3 is an exploded perspective view of two pairs of plates employed in the heat exchanger of FIGS. 1 and 2.
Figure 4:
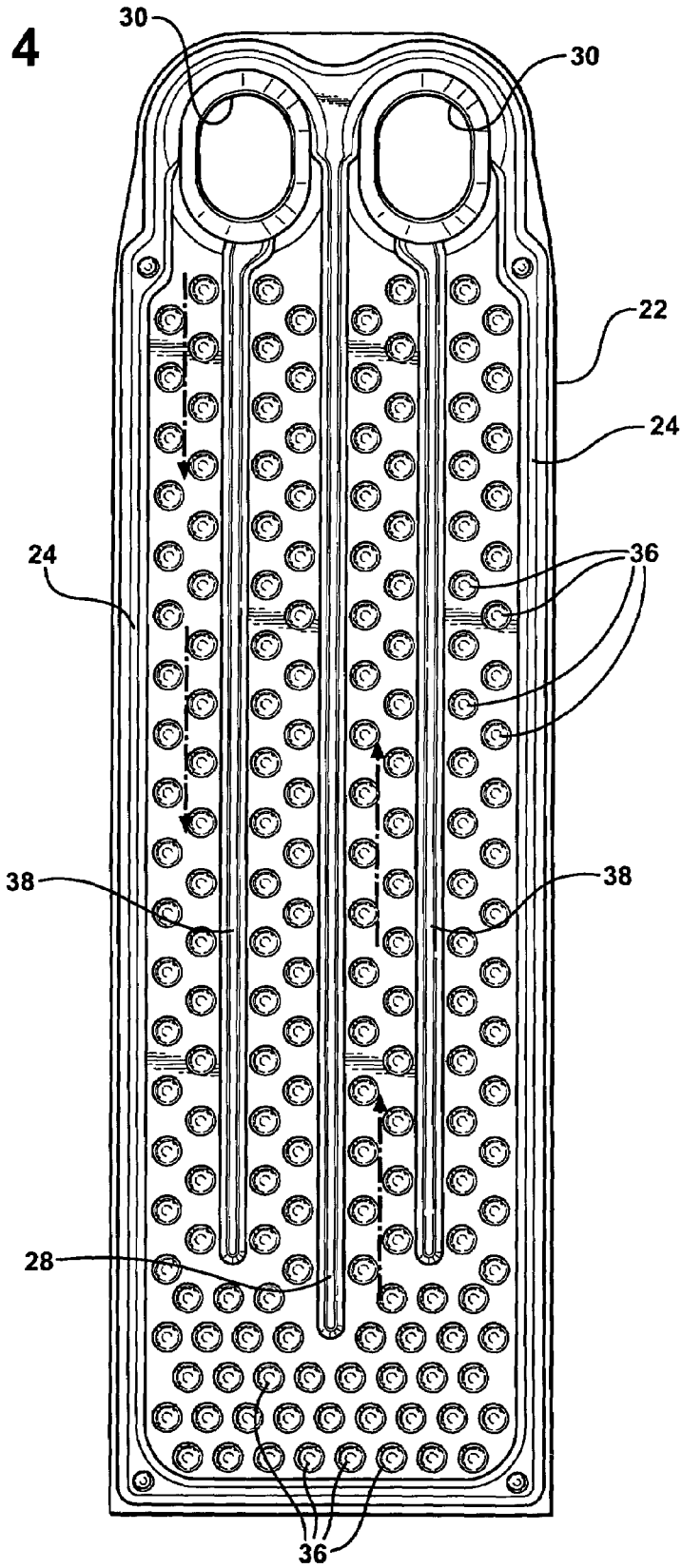
FIG. 4 is an elevational view of one plate incorporating the subject invention.

A heat exchanger assembly is variously shown in the Figures and includes as a basic component at least one pair 20 of plates 22. The plates 22 can be identical and disposed in mirror relationship to one another. The plates 22 have mating edges 24 and a concave region delimited by the edges 24 to define a fluid passage 26 between said pair 20 of plates 22. The assembly includes a plurality of pairs 20 of the plates 22 disposed in series for fluid flow from a pass through one pair 20 of plates 22 to a pass through the next pair 20 of plates 22, as illustrated by the arrows in FIG. 3. Each pair 20 of plates 22 includes a central rib 28 to define a U-shaped passage 26 having a fluid entering leg and a fluid exiting leg interconnected by an open bottom interconnecting the legs below the lower end of the engaging central ribs 28. The plates 22 have tubular projections 30 defining an inlet for entering fluid to the passage 26 and an outlet for exiting fluid from the passage 26 to thereby establish a direction of fluid flow, as indicated by the arrows in FIGS. 1 and 4.

As is well known, the heat exchanger assembly normally includes air-fins 32 disposed between adjacent pairs 20 of plates 22 for enhancing heat exchange between air flowing (as shown by the air flow arrow in FIG. 1) through the air-fins 32 and fluid flow through the passage 26 defined by each pair 20 of plates 22.

Figure 6:
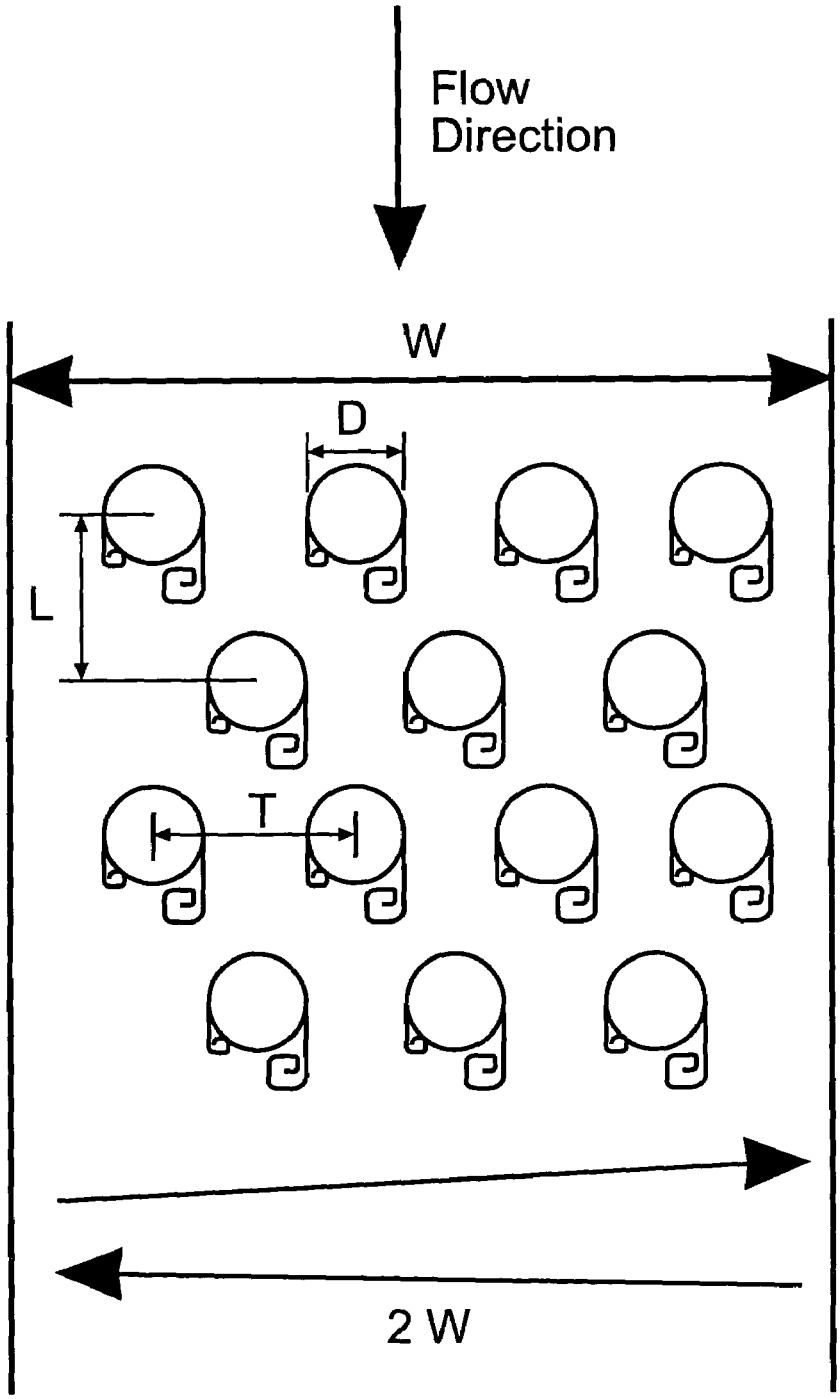
FIG. 6 is a schematic view for relating channel width to resonant frequency.

A plurality of dimples 36 project into the passage 26 to interact with fluid flow through the passage 26 and each of the dimples 36 has a hemispherical shape. Each of the dimples 36 has a hemispherical shape defining a diameter D and the dimples 36 are spaced apart transversely to the direction of flow a distance less than the diameter D. As shown in FIG. 6, the centers of the hemisphereical dimples 36 are spaced laterally apart a distance T, and that center to center distance T is such that $$\frac{LT}{D^2} \leq 45.$$

The distance between centers of adjacent dimples 36 in the direction of flow is indicated by L and the width of each passage 26 is indicated by W.

The dimples 36 of the plates 22 of each matched pair 20 may contact one another to hold the plates 22 of each pair 20 apart for the flow through the fluid passage 26. The dimples 36 are disposed in at least a selected section of the last pair 20 of plates 22 defining the last pass of fluid flow through the entire heat exchanger assembly. The dimples 36 may also be disposed in at least the last two pairs 20 of plates 22 defining the last two passes. The dimples 36 may be disposed in the legs and not in the bottom of the U-shaped passage 26 or may also be disposed in the bottom of the U-shaped passage 26 below the bottom end of the mating central ribs 28.

Figure 5:
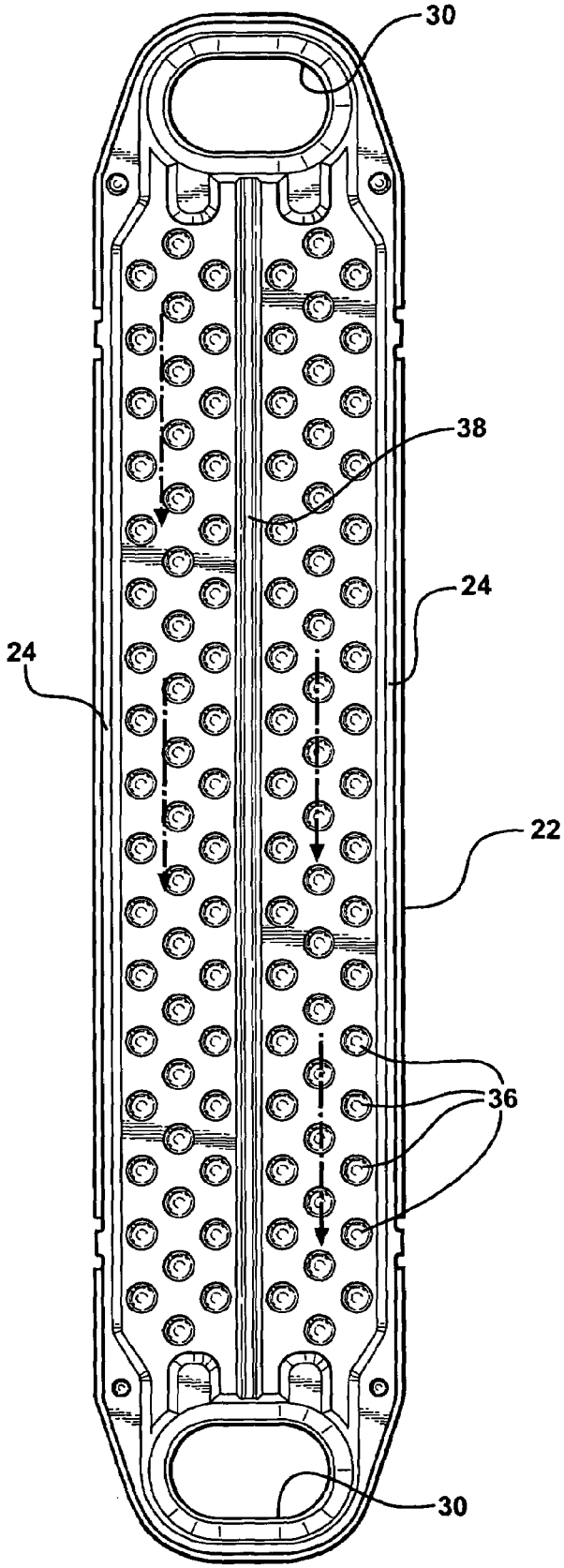
FIG. 5 is an elevational view of one plate of a rectangular cup evaporator in which the subject invention is incorporated.

A flow divider rib 38 is disposed in the fluid passage 26 and is parallel to the direction of fluid flow to thereby divide the fluid passage 26. As illustrated in FIGS. 1-4, each of the pair 20 of plates 22 includes a central rib 28 to define a U-shaped passage 26 having a fluid entering leg and a fluid exiting leg interconnected by an open bottom and one of the divider ribs 38 is disposed in at least one, and preferably each, of the legs. The central rib 28 extends farther down into the U-shaped passage 26 and the open bottom than the divider rib 38. As illustrated in FIG. 5, the divider rib 38 extends between the inlet for fluid entering the passage 26 at the top and an outlet at the bottom for fluid exiting from the single passage 26.

Although the divider rib 38 is shown dividing the passage 26 into equal paths, the divider rib 38 could divide the passage 26 into unequal paths.

Obviously, many modifications and variations of the present invention are possible in light of the above teachings. The invention may be practiced otherwise than as specifically described within the scope of the appended claims.

What is claimed is:

1. A heat exchanger assembly comprising:

at least one pair of plates having mating edges and a concave region delimited by said edges to define a fluid passage between said pair of plates, said plates having tubular projections defining an inlet for entering fluid to said passage and an outlet for exiting fluid from said passage to thereby establish a direction of fluid flow, a plurality of dimples projecting into said passage to interact with fluid flow through said passage, a flow divider rib disposed in said fluid passage and parallel to said direction of fluid flow to thereby divide said fluid passage so that said direction of fluid flow is divided into parallel flows in the same direction on both sides of said flow divider rib from said inlet to said outlet, and each of said dimples defines a hemispherical shape having a diameter and said dimples are spaced apart transversely to said direction of flow a distance less than said diameter so as to be disposed in overlapping relationship in said direction of fluid flow.

2. An assembly as set for in claim 1 wherein said dimples are spaced apart transversely and longitudinally according to the relationship $$\frac{LT}{D^2} \leq 45$$

wherein D is said diameter of said dimples and T is the lateral distance from center to center of adjacent dimples and L is the distance between the centers of adjacent dimples in the direction of flow.

3. An assembly as set forth in claim 2 wherein each of said pair of plates includes a central rib to define a U-shaped passage having a fluid entering leg and a fluid exiting leg interconnected by an open bottom, said flow divider rib being disposed in at least one of said legs to divide said fluid flow in said leg.

4. An assembly as set forth in claim 1 wherein each of said pair of plates includes a central rib to define a U-shaped passage having a fluid entering leg and a fluid exiting leg interconnected by an open bottom, said flow divider rib being disposed in at least one of said legs to divide said fluid flow in said leg.

5. An assembly as set forth in claim 4 wherein said central rib extends farther down into said U-shaped passage than said divider rib.

6. An assembly as set forth in claim 5 wherein each of said dimples has a hemispherical shape defining a diameter and said dimples are spaced apart transversely to said direction of flow a distance given by $$\frac{LT}{D^2} \leq 45$$

wherein D is said diameter of said dimples and T is the lateral distance from center to center of adjacent dimples and L is the distance between the centers of adjacent dimples in the direction of flow.

7. An assembly as set forth in claim 4 including one of said divider ribs disposed in each of said legs and said central rib extends farther down into said U-shaped passage than said divider ribs.

8. An assembly as set forth in claim 7 including a plurality of pairs of said plates disposed in series for fluid flow from a pass through one pair of plates to a pass through the next pair of plates.

9. An assembly as set forth in claim 8 wherein said dimples are disposed in at least the last two pair of plates defining the last two passes.

* * * * *